United States Patent [19]

Monroe

[11] 4,373,355

[45] Feb. 15, 1983

[54] DUAL REFRIGERATED DISPLAY CABINET

[75] Inventor: John E. Monroe, Los Angeles, Calif.

[73] Assignee: Displaymor Manufacturing Company, Inc., Los Angeles, Calif.

[21] Appl. No.: 255,561

[22] Filed: Apr. 20, 1981

[51] Int. Cl.[3] ..... A47F 3/04

[52] U.S. Cl. ..... 62/256

[58] Field of Search ..... 62/282, 82, 256, 255

[56] References Cited

U.S. PATENT DOCUMENTS

| | | | |
|---|---|---|---|
| 3,010,290 | 11/1961 | Fredrick | 62/256 |
| 3,115,019 | 12/1963 | Rutishauser | 62/256 |
| 3,306,068 | 2/1967 | Allgeyer et al. | 62/256 |
| 4,267,706 | 5/1981 | Abraham | 62/256 |
| 4,314,458 | 2/1982 | Hade et al. | 62/256 |

*Primary Examiner*—Lloyd L. King

*Attorney, Agent, or Firm*—Mahoney & Schick

[57] ABSTRACT

A refrigerated display case incorporates oppositely disposed display areas and has a common plenum chamber in fluid communication with said display areas. Common refrigerating coil means and compressor means provide refrigerated air to said plenum chamber for distribution to the oppositely disposed display areas.

4 Claims, 2 Drawing Figures

DUAL REFRIGERATED DISPLAY CABINET

BACKGROUND OF THE INVENTION

Refrigerated display cases having open display areas are widely utilized in markets to display merchandise which must be maintained in refrigerated condition. Some of these devices consist of open top receptacles which contain the refrigerated merchandise. Others provide vertically oriented display areas which permit greater accessibility to the products displayed and a more cosmetic arrangement of the products. A device of this character is disclosed in U.S. Pat. No. 3,010,290.

Prior art display cases of the character of those disclosed in the '290 patent have been widely utilized for the display of a broad range of comestibles such as eggs, spirituous beverages, preserved meats and the like. However, they have been characterized by the fact that they are somewhat restricted in capacity and provide access at only one side of the cabinet or case.

OBJECTS AND ADVANTAGES OF THE INVENTION

It is, therefore, an object of my invention to provide a refrigerated display case which is characterized by the fact that it provides oppositely disposed display areas which display merchandise and provide access to the same from opposite aisles of a market in which the display case is utilized.

Another object of my invention is the provision of a display case having oppositely oriented, dual display areas which incorporates a common plenum chamber and common refrigeration and cooling coil means whereby significant economies are achieved in the energy utilized to energize a common compressor.

As a matter of fact, I have discovered that it is possible to display double the amount of refrigerated merchandise by utilizing a compressor of slightly greater energy consumption than that previously utilized in the prior art display case disclosed in U.S. Pat. No. 3,010,290.

This provides an energy saving of approximately 75% over prior art devices. Consequently when a large number of such display cases are utilized in a supermarket or the like, the energy savings are really significant.

Also of considerable significance is the fact that maintenance costs are considerably reduced because one compressor is utilized to refrigerate twice the amount of refrigerated merchandise as in prior art devices.

A concomitant advantage of the display case of my invention is the space saving feature wherein a single case will service the aisles on opposite sides of the case and it is possible to greatly reduce the square footage of the supermarket utilized to display double the amount of merchandise.

Another object of my invention is the provision of a display case of the aforementioned character in which the common plenum chamber has the refrigerated coil located in fluid communication therewith and common upper and lower passageways communicating respectively with the upper and lower extremities of the oppositely disposed display areas.

BRIEF DESCRIPTION OF THE DRAWINGS

Other objects and advantages of the invention will be apparent from the following specification and the accompanying drawing in which.

DESCRIPTION OF A PREFERRED EMBODIMENT OF THE INVENTION

Figure 1:
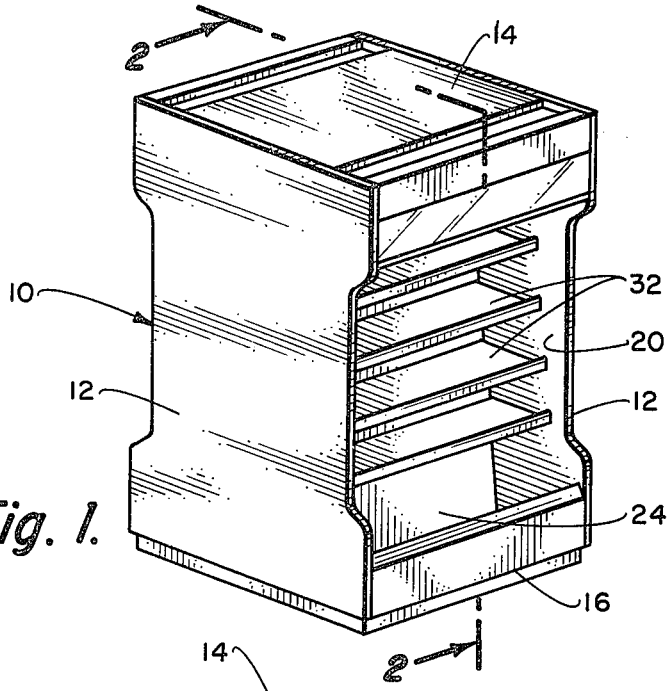
FIG. 1 is an isometric view of a dual refrigerated display case manufactured in accordance with the teachings of my invention.
Figure 2:
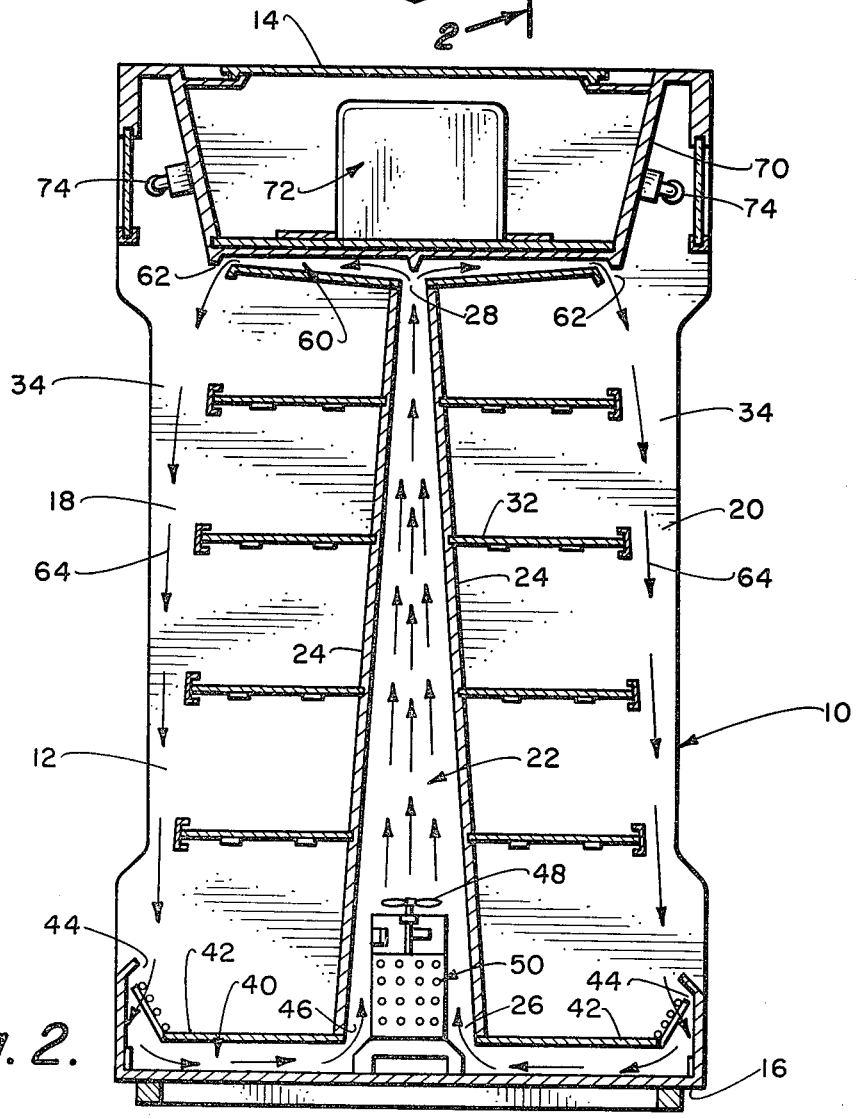
FIG. 2 is a vertical sectional view taken on the broken line 2—2 of FIG. 1.

Referring to the drawing, and particularly to FIGS. 1 and 2 thereof, I show a refrigerated display case 10 constructed in accordance with the teachings of the invention and including spaced sidewalls 12 maintained in operative and spaced relationship with each other by top wall means indicated generally at 14 and bottom wall means indicated generally at 16. The sidewalls 12, in conjunction with the top wall means 14 and bottom wall means 16, define oppositely and vertically oriented display areas 18 and 20 for the display of food stuffs or the like, in a manner to be described in greater detail hereinbelow.

Located centrally of the refrigerated display case 10 is a common plenum chamber 22, said plenum chamber being defined by inclined walls 24 which extend between the sidewalls 12 to define a fluid flow path between the lower extremity 26 and the upper extremity 28 of said plenum chamber. Mounted in said oppositely disposed display areas 18 and 20 are shelves 32 for the reception of merchandise, said shelves being secured between the sidewalls 12 and having their outermost extremities disposed inwardly of the outer edges of the sidewalls 12 to provide fluid passages 34 for refrigerated air to permit the contents of said shelves to be exposed to said refrigerated air and maintained in optimum refrigerated condition, in a manner to be described in greater detail below.

The previously disclosed components of the display case may be manufactured from a wide variety of readily available materials, the sidewalls 12 and the top and bottom means 14 and 16 being fabricated from particle board having a suitable exterior and interior coating applied thereto while the shelves may be fabricated from perforated, enameled metal or the like.

The walls 24 of the plenum chamber can also be fabricated from suitably coated particle board which is of sufficiently insulative characteristics to maintain the refrigerated condition of the air propelled therethrough. Lower, fluid passageway means 40 is provided in the lower portion of the display case 10 and defined between the bottom means 16 and panels 42, said lower passageway having oppositely oriented intake openings or slots 44 to draw exhausted cooling air from the lower extremities of the display areas 18 and 20.

The central portion 46 of the lower passageway 40 is in fluid communication with the lower extremity 26 of the plenum chamber 22.

Situated in fluid communication with the plenum chamber 22 and in the path of the air drawn through the lower passageway 40 by an electrically driven fan 48 is a refrigerant coil 50 which, in the present embodiment of the invention, is located in the lower extremity of the plenum chamber 22 to permit the fan 48 to draw air across it to refrigerate the air and, ultimately, propel it upwardly to the upper extremity 28 of the plenum chamber 22.

From the upper extremity 28 of the plenum chamber 22 the refrigerated air flows in opposite directions through an upper fluid passageway means 60 to outlet openings or slots 62 in fluid communication with the upper extremities of the oppositely oriented display areas 18 and 20 causing curtains of refrigerated air to flow downwardly in the direction of the arrows 64 to refrigerate the merchandise exposed upon the shelves 32.

An enclosure 70 is provided in the upper extremity of the display case 10 and houses a compressor unit 72 maintained in fluid communication with the coil 50 by suitable conduits, not shown. Fluid communication with the ambient air is maintained with the interior of the enclosure 70 by suitable means, such as openings in the top wall means 14, to permit the circulation of cooling air in said enclosure 70 around the components of the compressor 72. Concealed light fixtures 74 illuminate the contents of the shelves 32 and are located in spaces defined between the exterior of the enclosure 70 and corresponding portions of the refrigerated display case 10.

When the compressor 72 operates to provide refrigerant to the coil 50 and the propelling fan 48 is energized ambient air is drawn through the intake openings or slots 44 of the lower fluid passageway 40 being sucked from said fluid passageway 40 into the lower extremity 26 of the plenum chamber 22 across the refrigerant coils 50. The refrigerated air is propelled upwardly to the upper extremity or outlet 28 of the plenum chamber 22 and thence in opposite directions through the upper passageway 60 and the oppositely oriented outlet openings or slots 62. Refrigerated air then descends into the oppositely oriented display spaces 18 and 20 in the direction of the arrows 64 refrigerating the merchandise displayed upon the shelves 32 and ultimately being drawn again into the lower passageway to repeat the cycle described hereinabove.

A plurality of openings, not shown, are provided in the walls 24 of the plenum chamber and establish a communication between the plenum chamber and the spaces between the shelves 32. Therefore, when the refrigerated air is driven upwardly through the plenum chamber a portion of said air is diverted through the openings into the spaces between the shelves 32 to cause additional refrigeration of the comestibles or other objects disposed upon said shelves.

Therefore, as the curtain of refrigerated air indicated by the arrows 64 flows downwardly over the ends of the shelves in the spaces constituted by the oppositely disposed fluid passageways 34, the downward flow of the refrigerated air assists in the aspiration of the refrigerated air through the openings, not shown, in the walls 24 of the plenum chamber, thus intimately exposing the comestibles or other articles disposed upon the shelves 32 to an additional flow of refrigerated air.

The energy saving implications of the invention are obvious and of great importance in the context of the present energy crisis. Also of great importance when the energy costs of building space are considered are the space saving characteristics of the refrigerated display case 10 since it provides dual display areas on opposite sides of the cabinet in a total cubic foot capsule which is substantially less than the area consumed by the utilization of two prior art refrigerated display cases.

I claim:

1. In a display case, the combination of: a housing having sidewalls and top and bottom walls for maintaining said sidewalls in spaced relationship with each other, said housing having open sides providing communication with first and second display areas at opposite sides of said housing; a common plenum chamber defined by said sidewalls and inclined walls located centrally of said housing and extending between said sidewalls; a lower passageway in communication with the lower extremity of said plenum chamber; an upper passageway in communication with the upper extremity of said plenum chamber is discharge refrigerated air downwardly across said display areas at the opposite sides of said display case; a refrigerated coil located in the flow path to said plenum chamber to refrigerate the air flowing into said plenum chamber; and a compressor located in said housing in communication with said refrigerated coil to introduce refrigerant into said refrigerated coil and cause chilling of the air passing through said coil into said plenum chamber.

2. A display case of the character defined in claim 1 in which said refrigerated coil has air propulsion means associated therewith for propelling refrigerated air upwardly through said plenum chamber, outwardly through opposed portions of said upper passageway and downwardly across the oppositely located display areas of said case.

3. A display case of the character defined in claim 1 in which said plenum chamber is defined by inclined walls extending between the sidewalls of said case and in which said refrigerated coils are located in the lower extremity of said plenum chamber.

4. A display case as defined in claim 3 in which said compressor is located at the upper extremity of said case and disposed in fluid communication with said coils located in said plenum chamber.

* * * * *